US010273953B2

(12) United States Patent
Simmons et al.

(10) Patent No.: US 10,273,953 B2
(45) Date of Patent: Apr. 30, 2019

(54) METHODS OF MANUFACTURING A PNEUMATIC RECIPROCATING FLUID PUMP WITH IMPROVED CHECK VALVE ASSEMBLY

(71) Applicant: WHITE KNIGHT FLUID HANDLING INC., Kamas, UT (US)

(72) Inventors: John M. Simmons, Marion, UT (US); Tom M. Simmons, Kamas, UT (US); David M. Simmons, Francis, UT (US); Kenji A. Kingsford, Oro Valley, AZ (US); Bruce Johnson, West Valley, UT (US)

(73) Assignee: WHITE KNIGHT FLUID HANDLING INC., Kamas, UT (US)

( * ) Notice: Subject to any disclaimer, the term of this patent is extended or adjusted under 35 U.S.C. 154(b) by 0 days.

(21) Appl. No.: 15/680,993

(22) Filed: Aug. 18, 2017

(65) Prior Publication Data

US 2017/0342977 A1 Nov. 30, 2017

Related U.S. Application Data

(62) Division of application No. 14/262,146, filed on Apr. 25, 2014, now Pat. No. 10,036,382.

(Continued)

(51) Int. Cl.
*F04B 53/10* (2006.01)
*F04B 43/02* (2006.01)

(52) U.S. Cl.
CPC ..... *F04B 53/1002* (2013.01); *F04B 43/026* (2013.01); *F04B 53/1087* (2013.01); *Y10T 29/49236* (2015.01)

(58) Field of Classification Search
CPC .. F04B 53/1002; F04B 53/1007; F04B 45/04; F04B 45/043; F04B 43/0736; Y10T 29/49236

(Continued)

(56) References Cited

U.S. PATENT DOCUMENTS 3,346,008 A 10/1967 Scaramucci
4,936,753 A * 6/1990 Kozumplik, Jr. ..... F04B 43/026 417/238

(Continued)

FOREIGN PATENT DOCUMENTS

CN 101037992 A 9/2007
CN 102518578 A 6/2012

(Continued)

OTHER PUBLICATIONS

Korean Notice of Preliminary Rejection, Korean Patent Application No. 10-2015-7026059; dated Jul. 28, 2017, with English translation, 14 pages.

(Continued)

*Primary Examiner* — Kenneth J Hansen
(74) *Attorney, Agent, or Firm* — TraskBritt

(57) ABSTRACT

A pneumatic reciprocating fluid pump for pumping a fluid includes at least one check valve assembly that includes a check valve body insert, a ball within the valve body insert, and an annular sealing ring member disposed within a seat ring receptacle. The sealing ring member has dimensions smaller than corresponding dimensions of the seat ring receptacle, such that the sealing ring member is capable of moving within the seat ring receptacle. The ball is configured to slide back and forth between a first position and a second position within the check valve body insert responsive to forward and reverse flow of fluid therethrough. In one position, the ball is seated against the sealing ring member (Continued)

and prevents reverse flow of the fluid through the check valve assembly, and forward flow of the fluid through the check valve assembly is enabled when the ball is in another position.

20 Claims, 9 Drawing Sheets

Related U.S. Application Data

(60) Provisional application No. 61/822,077, filed on May 10, 2013.

(58) Field of Classification Search
USPC ..... 277/644
See application file for complete search history.

(56) References Cited

U.S. PATENT DOCUMENTS

| | | | | |
|---|---|---|---|---|
| 5,169,296 | A | 12/1992 | Wilden | |
| 5,370,507 | A * | 12/1994 | Dunn | F04B 15/04 137/533.15 |
| 5,558,506 | A | 9/1996 | Simmons et al. | |
| 5,893,707 | A | 4/1999 | Simmons et al. | |
| 6,105,610 | A | 8/2000 | Watkins et al. | |
| 6,106,246 | A | 8/2000 | Steck et al. | |
| 6,142,749 | A | 11/2000 | Jack et al. | |
| 6,295,918 | B1 | 10/2001 | Simmons et al. | |
| 6,402,486 | B1 | 6/2002 | Steck et al. | |
| 6,685,443 | B2 | 2/2004 | Simmons et al. | |
| 6,695,593 | B1 | 2/2004 | Steck et al. | |
| 6,957,952 | B1 | 10/2005 | Steck et al. | |
| 7,134,849 | B1 | 11/2006 | Steck et al. | |
| 7,458,309 | B2 | 12/2008 | Simmons et al. | |
| 8,636,484 | B2 | 1/2014 | Simmons et al. | |
| 2005/0257927 | A1 | 11/2005 | Coyes et al. | |
| 2009/0166979 | A1 | 7/2009 | Horie et al. | |
| 2010/0028174 | A1 * | 2/2010 | Headley | F04B 43/0736 417/393 |
| 2010/0117310 | A1 * | 5/2010 | Celik | C09K 3/10 277/650 |
| 2010/0247334 | A1 | 9/2010 | Simmons et al. | |
| 2013/0068982 | A1 | 3/2013 | Alink et al. | |
| 2013/0280102 | A1 | 10/2013 | Simmons et al. | |

FOREIGN PATENT DOCUMENTS

| | | | |
|---|---|---|---|
| DE | 2653160 | A1 | 5/1978 |
| JP | 51004097 | U | 1/1976 |
| JP | 5233729 | U | 3/1977 |
| JP | 52132421 | U | 10/1977 |
| JP | 52132421 | A | 11/1977 |
| JP | 5699159 | U | 8/1981 |
| JP | 5811130 | U | 7/1983 |
| JP | 09105473 | A | 4/1997 |
| JP | 2001141084 | A | 5/2001 |
| JP | 2006200429 | A | 8/2006 |
| JP | 2010025032 | A | 2/2010 |
| JP | 2010038276 | A | 2/2010 |
| JP | 2010281259 | A | 12/2010 |
| JP | 5233729 | B2 | 7/2013 |
| JP | 5699159 | B2 | 4/2015 |

OTHER PUBLICATIONS

Chinese Third Office Action dated Dec. 7, 2017 for Chinese Patent Application No. 201480025145.5, 18 pages.

Notification of Reasons for Refusal in Japanese Patent Application No. 2016-512927 dispatched Jan. 31, 2018; with English Translation (7 pages).

Search Report in Japanese Patent Application No. 2016-512927 dispatched Jan. 25, 2018; with English Translation (35 pages).

Korean Notice of Last Preliminary Rejection, Korean Patent Application No. 10-2015-7026059; dated Mar. 30, 2018, with English translation, 16 pages.

Chinese Second Office Action dated Jul. 4, 2017 for Chinese Patent Application No. 201480025145.5, 18 pages.

Chinese First Office Action dated Oct. 19, 2016 for Chinese Patent Application No. 2014800251455, 11 pages.

First Office Action dated Mar. 22, 2017 for German Patent Application No. 11-2014-002-350.7, 4 pages.

International Preliminary Report on Patentability, for International Application No. PCT/US2014/035489, dated Nov. 19, 2015, 13 pages.

International Search Report and Written Opinion of the International Searching Authority for International Application No. PCT/US2014/035489, dated Sep. 1, 2014, 17 pages.

Taiwan Office Action for Taiwan Patent Application No. TW103116059, dated Oct. 11, 2016, 5 pages.

Taiwan Examination and Search Report for Taiwan Patent Application No. 103116059, received Mar. 15, 2016, 17 pages.

Fourth Office Action in Chinese Patent Application No. 2014800251455, dated Apr. 11, 2018 (18 pages) with translation.

Notice of Final Rejection for Korean Patent Application No. 10-2015-7026059, dated Oct. 30, 2018 (7 pages) with translation.

* cited by examiner

METHODS OF MANUFACTURING A PNEUMATIC RECIPROCATING FLUID PUMP WITH IMPROVED CHECK VALVE ASSEMBLY

CROSS-REFERENCE TO RELATED APPLICATIONS

This application is a divisional of U.S. patent application Ser. No. 14/262,146, filed Apr. 25, 2014, now U.S. Pat. No. 10,036,382, issued Jul. 31, 2018, which application claims the benefit of U.S. Provisional Patent Application Ser. No. 61/822,077, filed May 10, 2013, the disclosure of each of which is hereby incorporated herein in its entirety by this reference.

TECHNICAL FIELD

Embodiments of the present disclosure relate generally to reciprocating fluid pumps, to components for use with such pumps, and to methods of fabricating such reciprocating fluid pumps and components.

BACKGROUND

Reciprocating fluid pumps are used in many industries. Reciprocating fluid pumps generally include two subject fluid chambers in a pump body for effecting movement of a volume of subject fluid. A reciprocating piston, which may also be characterized as a shaft, is driven back and forth within the pump body. One or more plungers (e.g., diaphragms or bellows) may be connected to the reciprocating piston or shaft. As the reciprocating piston moves in one direction, the movement of the plungers results in subject fluid being drawn into a first chamber of the two subject fluid chambers and expelled from the second chamber. As the reciprocating piston moves in the opposite direction, the movement of the plungers results in fluid being expelled from the first chamber and drawn into the second chamber. A fluid inlet and a fluid outlet may be provided in fluid communication with the first subject fluid chamber, and another fluid inlet and another fluid outlet may be provided in fluid communication with the second subject fluid chamber. The fluid inlets to the first and second subject fluid chambers may be in fluid communication with a common single pump inlet, and the fluid outlets from the first and second subject fluid chambers may be in fluid communication with a common single pump outlet, such that subject fluid may be drawn into the pump through the pump inlet from a single fluid source, and subject fluid may be expelled from the pump through a single pump outlet. Check valves may be provided at the fluid inlets and outlets to ensure that fluid can only flow into the subject fluid chambers through the fluid inlets, and fluid can only flow out of the of the subject fluid chambers through the fluid outlets.

Conventional reciprocating fluid pumps operate by shifting the reciprocating piston back and forth within the pump body. Shifting of the reciprocating piston from one direction to the other may be accomplished by using a shuttle valve, which provides drive fluid (e.g., pressurized air) to a first drive chamber associated with a first plunger and then shifts the drive fluid to a second drive chamber associated with a second plunger as the first plunger reaches a fully extended position. The shuttle valve includes a spool that shifts from a first position that directs the drive fluid to the first drive chamber to a second position that directs the drive fluid to the second drive chamber. Shifting of the shuttle valve spool may be accomplished by providing fluid communication between the drive chamber and a shift conduit when each plunger is fully extended, which enables the drive fluid to pressurize the shift conduit to shift the shuttle valve spool from one position to the other. During the rest of the pumping stroke, however, the opening to the shift conduit is kept sealed from the drive chamber to keep the shuttle valve spool from prematurely shifting and to improve the efficiency of the reciprocating fluid pump.

Examples of reciprocating fluid pumps and components thereof are disclosed in, for example: U.S. Pat. No. 5,370,507, which issued Dec. 6, 1994 to Dunn et al.; U.S. Pat. No. 5,558,506, which issued Sep. 24, 1996 to Simmons et al.; U.S. Pat. No. 5,893,707, which issued Apr. 13, 1999 to Simmons et al.; U.S. Pat. No. 6,106,246, which issued Aug. 22, 2000 to Steck et al.; U.S. Pat. No. 6,295,918, which issued Oct. 2, 2001 to Simmons et al.; U.S. Pat. No. 6,685,443, which issued Feb. 3, 2004 to Simmons et al.; U.S. Pat. No. 7,458,309, which issued Dec. 2, 2008 to Simmons et al.; and U.S. Pat. No. 8,636,484, which issued Jan. 28, 2014 to Simmons et al. The disclosure of each of these patents is respectively incorporated herein in its entirety by this reference.

BRIEF SUMMARY

In some embodiments, the present disclosure includes a pneumatic reciprocating fluid pump for pumping a subject fluid. The pump includes a pump body having at least one interior cavity therein, and a plunger disposed within the at least one interior cavity in the pump body. The pump body and the plunger define at least one subject fluid chamber within the interior cavity on a first side of the plunger and at least one subject fluid chamber within the interior cavity on an opposing second side of the plunger. The plunger is configured to expand and contract the first subject fluid chamber responsive to pressurization and depressurization of the drive fluid chamber with a drive fluid. The pump further includes at least one check valve assembly located and configured to allow forward flow of the subject fluid flowing through the fluid pump and at least substantially prevent reverse flow of the subject fluid flowing through the fluid pump. The at least one check valve assembly includes a check valve body insert configured to be received in a complementary recess in the pump body. The check valve body insert and surfaces of the pump body within the complementary recess together define an annular seat ring receptacle between an end of the check valve body insert and the surfaces of the body within the complementary recess. The check valve assembly further includes an annular sealing ring member disposed within the seat ring receptacle. The sealing ring member has dimensions smaller than corresponding dimensions of the seat ring receptacle, such that the sealing ring member is capable of moving longitudinally and laterally within the seat ring receptacle. The check valve assembly further includes a ball disposed within the check valve body insert and configured to slide back and forth between a first position and a second position within the check valve body insert responsive to forward and reverse flow of the subject fluid through the at least one check valve assembly. In the second position, the ball is seated against the sealing ring member and prevents reverse flow of the subject fluid. Forward flow of the subject fluid through the at least one check valve assembly is enabled when the ball is in the first position.

Additional embodiments of the present disclosure include methods of forming fluid pumps as described herein. For example, in additional embodiments, the present disclosure includes a method of manufacturing a pneumatic reciprocating fluid pump that includes providing a pump body having at least one interior cavity therein and a plunger disposed within the at least one interior cavity. The pump body and the plunger define at least one subject fluid chamber within the interior cavity on a first side of the plunger, and at least one subject fluid chamber within the interior cavity on an opposing second side of the plunger. The plunger is configured to expand and contract the first subject fluid chamber responsive to pressurization and depressurization of the drive fluid chamber with a drive fluid. In accordance with the method, an annular sealing ring member is disposed within a recess in the pump body. A ball is disposed in a check valve body insert, and the check valve body insert is secured with the ball therein in the recess in the pump body, such that the check valve body insert and surfaces of the pump body within the recess together define an annular seat ring receptacle between an end of the check valve body insert and the surfaces of the body within the recess. The annular sealing ring member is disposed within the annular seat ring receptacle. The sealing ring member has dimensions smaller than corresponding dimensions of the sealing ring receptacle, such that the sealing ring member is capable of moving longitudinally and laterally within the seat ring receptacle. The check valve body insert, the ball, and the annular seat ring member together defining a check valve assembly in which the ball is configured to slide back and forth between a first position and a second position within the check valve body insert responsive to forward and reverse flow of the subject fluid through the at least one check valve assembly. The ball is seated against the sealing ring member and prevents reverse flow of the subject fluid when the ball is in the second position within the check valve body insert. Forward flow of the subject fluid through the at least one check valve assembly is enabled when the ball is in the first position.

DETAILED DESCRIPTION

The illustrations presented herein may not be, in some instances, actual views of any particular reciprocating fluid pump or component thereof, but may be merely idealized representations that are employed to describe embodiments of the present invention. Additionally, elements common between drawings may retain the same numerical designation.

As used herein, the term "substantially" in reference to a given parameter means to a degree that one skilled in the art would understand that the given parameter, property, or condition is met with a small degree of variance, such as within acceptable manufacturing tolerances.

As used herein, any relational term, such as "first," "second," "left," "right," etc., is used for clarity and convenience in understanding the disclosure and accompanying drawings and does not connote or depend on any specific preference, orientation, or order, except where the context clearly indicates otherwise.

As used herein, the term "subject fluid" means and includes any fluid to be pumped using a fluid pump as described herein.

As used herein, the term "drive fluid" means and includes any fluid used to drive a pumping mechanism of a fluid pump as described herein. Drive fluids include air and other gases.

Figure 1:
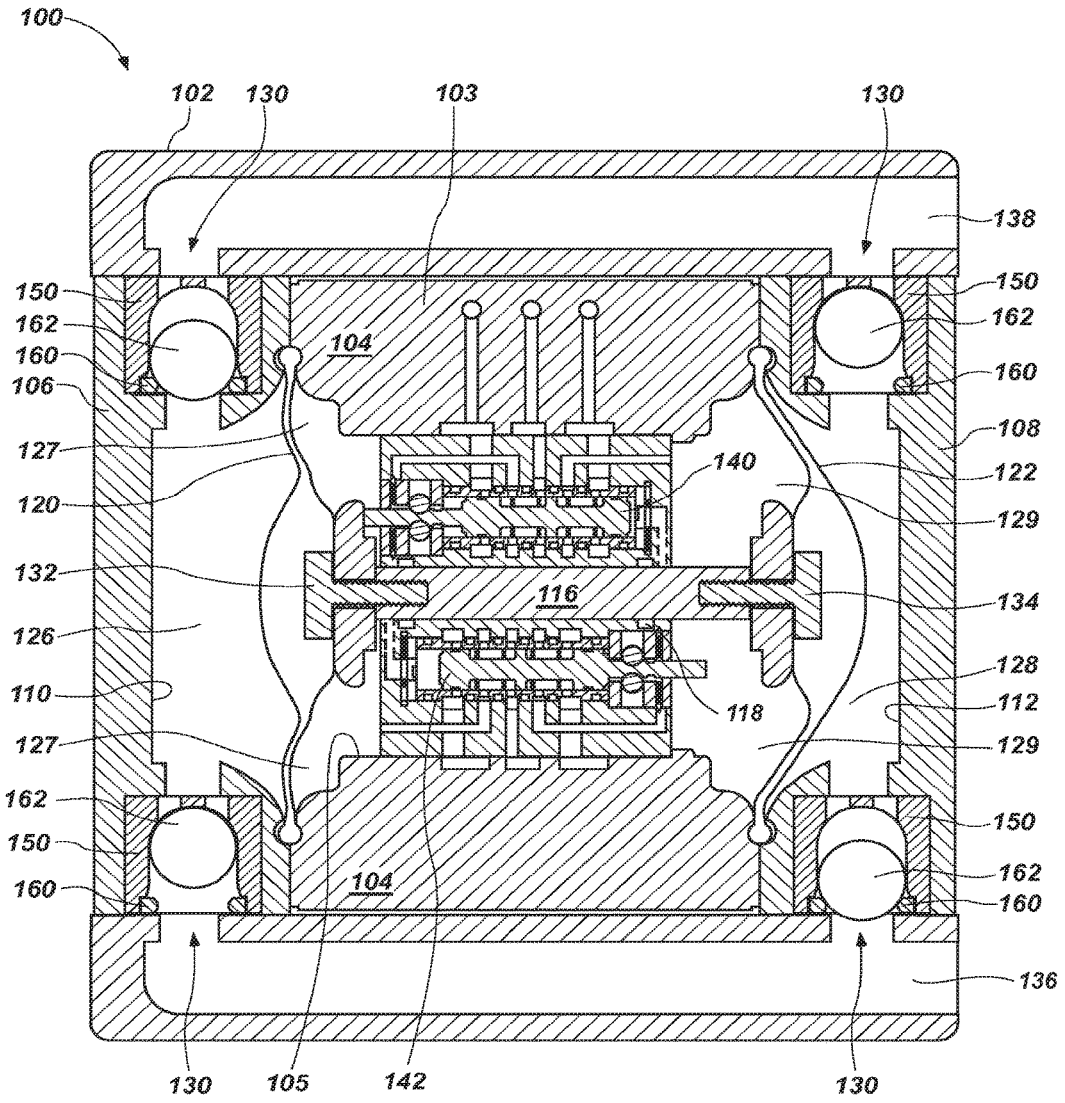
FIG. 1 is a schematically illustrated cross-sectional view of a pump according to an embodiment of the present disclosure.

FIG. 1 illustrates an embodiment of a fluid pump 100 of the present disclosure. In some embodiments, the fluid pump 100 is configured to pump a subject fluid, such as a liquid (e.g., water, oil, acid, etc.), using a pressurized drive fluid, such as compressed gas (e.g., air). Thus, in some embodiments, the fluid pump 100 may comprise a pneumatically operated liquid pump. Furthermore, as described in further detail below, the fluid pump 100 may comprise a reciprocating pump.

By way of non-limiting example, the fluid pump 100 may comprise a pneumatically operated reciprocating fluid pump substantially similar to that disclosed in U.S. patent application Ser. No. 13/452,077, which was filed Apr. 20, 2012, now U.S. Pat. No. 9,004,881, issued Apr. 14, 2015, in the name of Simmons et al., the disclosure of which is incorporated herein in its entirety by this reference.

The fluid pump 100 includes a pump body 102 or housing, which may comprise a central body 104, a first end body 106, and a second end body 108. The central body 104 may have a central cavity 105 formed therein. The central body 104, the first end body 106, and the second end body 108 may be sized, shaped, and otherwise configured to form a first cavity 110 and a second cavity 112 within the pump body 102 when the end bodies 106, 108 are attached to the central body 104. For example, a first cavity 110 may be formed between, and defined by, inner surfaces of each of the central body 104 and the first end body 106, and a second cavity 112 may be formed between, and defined by, inner surfaces of each of the central body 104 and the second end body 108.

A drive shaft 116 may be positioned within the central body 104, such that the drive shaft 116 extends through the central body 104 between the first cavity 110 and the second cavity 112. A first end of the drive shaft 116 may be positioned within the first cavity 110, and an opposite second end of the drive shaft 116 may be positioned within the second cavity 112. The drive shaft 116 is configured to slide back and forth within a bore in the central body 104. Furthermore, one or more fluid-tight seals 118 may be provided between the drive shaft 116 and the central body 104, such that fluid is prevented from flowing through any space between the drive shaft 116 and the central body 104.

A first plunger 120 may be disposed within the first cavity 110, and a second plunger 122 may be disposed within the second cavity 112. The plungers 120, 122 may comprise, for example, diaphragms or bellows comprised of a flexible polymer material (e.g., an elastomer or a thermoplastic material). The first plunger 120 may divide the first cavity 110 into a first subject fluid chamber 126 on a side of the first plunger 120 opposite the central body 104 (and proximate the first end body 106) and a first drive fluid chamber 127 on a side of the first plunger 120 proximate the central body 104 (and opposite the first end body 106). Similarly, the second plunger 122 may divide the second cavity 112 into a second subject fluid chamber 128 on a side of the second plunger 122 opposite the central body 104 (and proximate the second end body 108) and a second drive fluid chamber 129 on a side of the second plunger 122 proximate the central body 104 (and opposite the second end body 108).

A peripheral edge of the first plunger 120 may be disposed between the first end body 106 and the central body 104, and a fluid-tight seal may be provided between the first end body 106 and the central body 104 across the peripheral edge portion of the first plunger 120. The first end of the drive shaft 116 may be coupled to a portion of the first plunger 120. In some embodiments, the first end of the drive shaft 116 may extend through an aperture in a central portion of the first plunger 120, and one or more sealing attachment members 132 (e.g., nuts, screws, washers, seals, etc.) may be provided on the drive shaft 116 on one or both sides of the first plunger 120 to attach the first plunger 120 to the first end of the drive shaft 116, and to provide a fluid-tight seal between the drive shaft 116 and the first plunger 120, such that fluid cannot flow between the first subject fluid chamber 126 and the first drive fluid chamber 127 through any space between the drive shaft 116 and the first plunger 120.

Similarly, a peripheral edge of the second plunger 122 may be disposed between the second end body 108 and the central body 104, and a fluid-tight seal may be provided between the second end body 108 and the central body 104 across the peripheral edge portion of the second plunger 122. The second end of the drive shaft 116 may be coupled to a portion of the second plunger 122. In some embodiments, the second end of the drive shaft 116 may extend through an aperture in a central portion of the second plunger 122, and one or more sealing attachment members 134 (e.g., nuts, screws, washers, seals, etc.) may be provided on the drive shaft 116 on one or both sides of the second plunger 122 to attach the second plunger 122 to the second end of the drive shaft 116, and to provide a fluid-tight seal between the drive shaft 116 and the second plunger 122, such that fluid cannot flow between the second subject fluid chamber 128 and the second drive fluid chamber 129 through any space between the drive shaft 116 and the second plunger 122.

In this configuration, the drive shaft 116 is capable of sliding back and forth within the pump body 102. As the drive shaft 116 moves to the right (from the perspective of FIG. 1), the first plunger 120 will be caused to move and/or deform such that the volume of the first subject fluid chamber 126 increases and the volume of the first drive fluid chamber 127 decreases, and the second plunger 122 will be caused to move and/or deform such that the volume of the second subject fluid chamber 128 decreases and the volume of the second drive fluid chamber 129 increases. Conversely, as the drive shaft 116 moves to the left (from the perspective of FIG. 1), the first plunger 120 will be caused to move and/or deform such that the volume of the first subject fluid chamber 126 decreases and the volume of the first drive fluid chamber 127 increases, and the second plunger 122 will be caused to move and/or deform such that the volume of the second subject fluid chamber 128 increases and the volume of the second drive fluid chamber 129 increases.

A subject fluid inlet 136 may lead into the first subject fluid chamber 126 and/or the second subject fluid chamber 128. A subject fluid outlet 138 may lead out from the first subject fluid chamber 126 and/or the second subject fluid chamber 128.

In accordance with embodiments of the present disclosure, the fluid pump 100 may comprise one or more check valve assemblies 130 proximate the subject fluid inlet 136 and/or the subject fluid outlet 138. The check valve assemblies 130 are described in further detail below with reference to FIGS. 2 through 13. A check valve assembly 130 as described herein may be provided in each of the subject fluid inlets 136 and outlets 138 to limit or prevent subject fluid from flowing out from the subject fluid chambers 126, 128 through the subject fluid inlets 136, and/or to limit or prevent subject fluid being drawn into the subject fluid chambers 126, 128 from the subject fluid outlets 138.

The subject fluid inlet 136 may lead to both the first subject fluid chamber 126 and the second subject fluid chamber 128, such that fluid may be drawn into the fluid pump 100 through the subject fluid inlet 136 from a single fluid source. Similarly, the subject fluid outlet 138 may be fed from both the first subject fluid chamber 126 and the second subject fluid chamber 128, such that fluid may be expelled from the fluid pump 100 through a single fluid outlet line. In other embodiments, there may be multiple subject fluid inlets (not shown) and/or multiple subject fluid outlets (not shown), each in fluid communication with the first subject fluid chamber 126 and/or the second subject fluid chamber 128.

The first drive fluid chamber 127 may be pressurized with drive fluid, which may push the first plunger 120 to the left (from the perspective of FIG. 1). As the first plunger 120 moves to the left, the drive shaft 116 and the second plunger 122 are pulled to the left. As the drive shaft 116, the first plunger 120, and the second plunger 122 move to the left (from the perspective of FIG. 1), any subject fluid within the first subject fluid chamber 126 may be expelled from the first subject fluid chamber 126 through the respective subject fluid outlet 138 leading out from the first subject fluid chamber 126, and subject fluid will be drawn into the second subject fluid chamber 128 through the respective subject fluid inlet 136 leading to the second subject fluid chamber 128.

The second drive fluid chamber 129 may be pressurized with drive fluid, which may push the second plunger 122 to the right (from the perspective of FIG. 1). As the second plunger 122 moves to the right, the drive shaft 116 and the first plunger 120 may be pulled to the right. Thus, any subject fluid within the second subject fluid chamber 128 may be expelled from the second subject fluid chamber 128 through the subject fluid outlet 138 leading out from the second subject fluid chamber 128, and subject fluid may be drawn into the first subject fluid chamber 126 through the subject fluid inlet 136 leading to the first subject fluid chamber 126.

To drive the pumping action of the fluid pump 100, the first drive fluid chamber 127 and the second drive fluid chamber 129 may be pressurized in an alternating manner to cause the drive shaft 116, the first plunger 120, and the second plunger 122 to reciprocate back and forth within the pump body 102.

The fluid pump 100 may comprise a shifting mechanism for shifting the flow of pressurized drive fluid back and forth between the first drive fluid chamber 127 and the second drive fluid chamber 129 at the ends of the stroke of the drive shaft 116. Many such mechanisms are known in the art and may be employed in embodiments of the present disclosure. By way of non-limiting example, the shifting mechanism may comprise a first shift valve 140 and a second shift valve 142 as described in the aforementioned U.S. patent application Ser. No. 13/452,077, now U.S. Pat. No. 9,004,881, issued Apr. 14, 2015, and operation of the fluid pump 100 may be as is also described therein.

In some embodiments, the fluid pump 100 may be configured to pump a corrosive or reactive subject fluid, such as acid. In such embodiments, at least all components of the fluid pump 100 in contact with the subject fluid may be fabricated from or may have a coating of materials that are not corroded by, and do not react with, the subject fluid. For example, in embodiments in which the fluid pump 100 is configured to pump acid, at least the components of the fluid pump 100 in contact with the acid may comprise a polymer material (e.g., a thermoplastic or a thermosetting material). In some embodiments, such a polymer material may comprise a fluoropolymer. By way of example and not limitation, at least the components of the fluid pump 100 in contact with the acid may comprise one or more of neoprene, buna-N, ethylene propylene diene M-class (EPDM), VITON®, polyurethane, HYTREL®, SANTOPRENE®, fluorinated ethylene-propylene (FEP), perfluoroalkoxy fluorocarbon resin (PFA), ethylene-chlorotrifluoroethylene copolymer (ECTFE), ethylene-tetrafluoroethylene copolymer (ETFE), nylon, polyethylene, polyvinylidene fluoride (PVDF), polyvinyl chloride (PVC), NORDEL®, nitrile, polyethylene (PE), ultra-high molecular weight polyethylene (UHMWPE), polypropylene, (PP). Further, any such materials may include carbon filler or other filler materials if desired.

Figure 2:
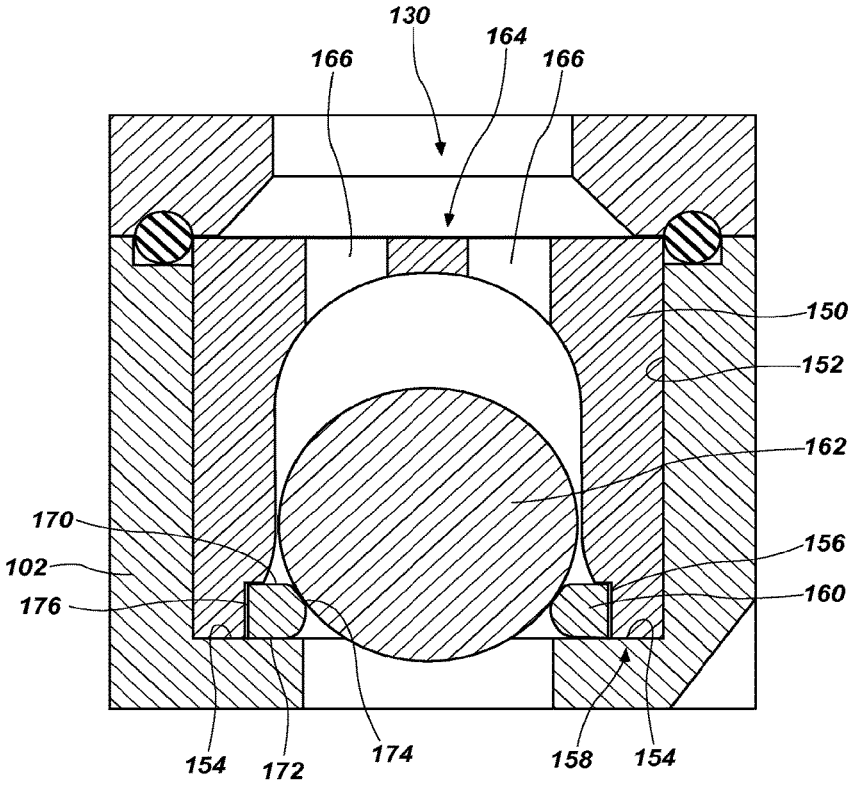
FIG. 2 is an enlarged view of a portion of FIG. 1 illustrating a check valve assembly that includes an annular seating ring member.

Each check valve assembly 130 of the fluid pump 100 may be located and configured to allow forward flow of the subject fluid flowing through the fluid pump 100, and to at least substantially prevent reverse flow of the subject fluid flowing through the fluid pump 100. Referring to FIG. 2, each check valve assembly 130 may include a check valve body insert 150 configured to be received in a complementary recess 152 in the central body 103 (FIG. 1) of the pump body 102. The check valve body insert 150 and surfaces 154 of the central body 103 of the pump body 102 within the complementary recess 152 together define an annular seat ring receptacle 156 between an end 158 of the check valve body insert 150 and the surfaces 154 of the body 103 within the complementary recess 152.

An annular sealing ring member 160 is disposed within the seat ring receptacle 156. The sealing ring member 160 may have a non-circular cross-sectional shape, as discussed below. The sealing ring member 160 may have dimensions smaller than corresponding dimensions of the seat ring receptacle 156 such that the sealing ring member is capable of moving longitudinally and laterally, or "floating" within the seat ring receptacle 156. By way of example and not limitation, a diameter of the seat ring receptacle 156 may be at least about 0.25 mm (0.010 inch), at least about 0.51 mm (0.020 inch), or even at least about 0.76 mm (0.030 inch) greater than a diameter of the sealing ring member 160. Further, a thickness of the seat ring receptacle 156 may be at least about 0.051 mm (0.002 inch), at least about 0.13 mm (0.005 inch), or even at least about 0.25 mm (0.010 inch) thicker than a thickness of the sealing ring member 160. The floating of the sealing ring member 160 may allow the sealing ring member 160 to conform more accurately to the shape of the ball and the surfaces defining the seat ring receptacle 156, which may relieve stresses and reduce wear over time. Additionally, the tighter seal may result in improved performance of the fluid pump 100 with respect to pressure and vacuum capability.

As shown in FIG. 2, in some embodiments, the annular sealing ring member 160 may have an at least substantially planar top surface 170, an at least substantially planar bottom surface 172, a rounded laterally inner side surface 174, and an at least substantially cylindrical laterally outer side surface 176. In such a configuration, the sealing ring member 160 has a "D-shaped" cross-sectional geometry. The ball 162 may be configured to abut and seal against the rounded laterally inner side surface 174 when the ball 162 is in the sealing position abutting against the sealing ring member 160.

The check valve assembly 130 may further include a ball 162 disposed within the check valve body insert 150, and may be configured to slide back and forth between a first position and a second position within the check valve body insert 150 responsive to forward and reverse flow of the subject fluid through the check valve assembly 130. Upon commencement of reverse flow of subject fluid through the check valve assembly 130, the ball 162 may move and be seated against the sealing ring member 160 by the reverse flow of the subject fluid. The ball 162 and the sealing ring member 160 together may then provide a fluid-tight seal within the check valve assembly 130 so as to prevent further reverse flow of the subject fluid when the ball 162 is in the second position within the check valve body insert 150. Upon commencement of forward flow of subject fluid through the check valve assembly 130, the ball 162 may move toward an opposite end 164 of the check valve body insert 150 wherein the ball 162 is separated a distance from the sealing ring member 160.

Figure 3A:
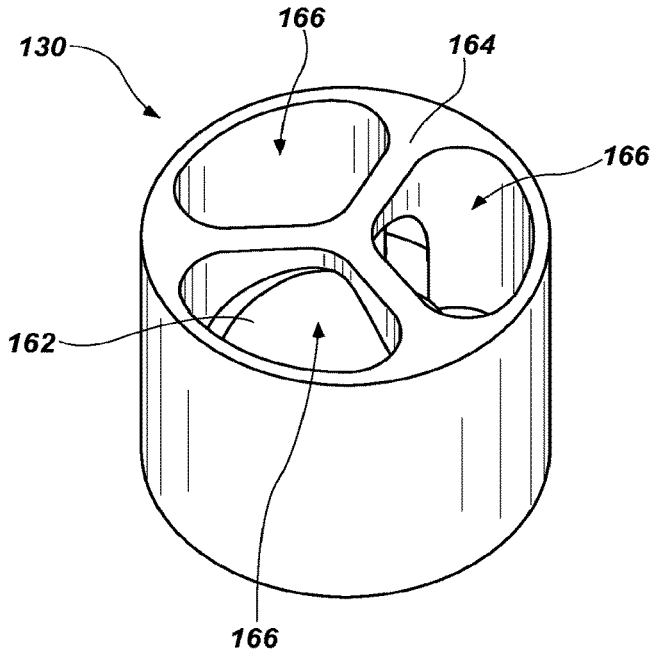
FIG. 3A is a perspective view of a check valve assembly of the pump shown in FIGS. 1 and 2.
Figure 3B:
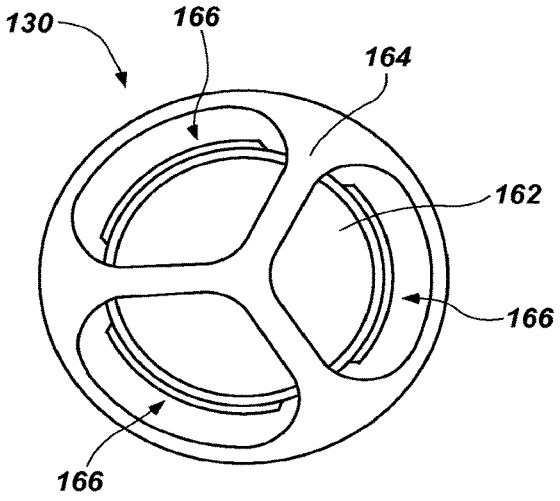
FIG. 3B is a top view of the check valve assembly of FIGS. 1 and 2.
Figure 3C:
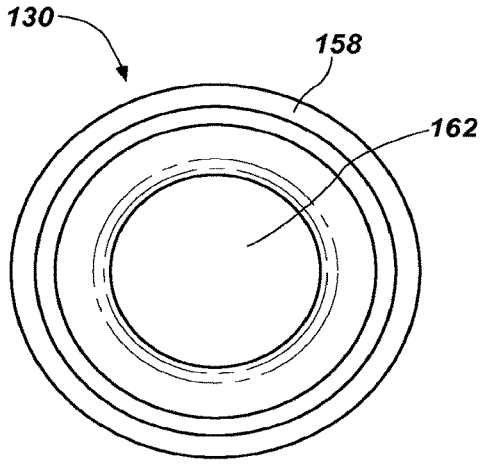
FIG. 3C is a bottom view of the check valve assembly of FIGS. 1 and 2.

As shown in FIGS. 3A and 3B, apertures 166 may be formed through the opposite end 164 of the check valve body insert 150 (FIGS. 1 and 2). The check valve body insert 150 and the ball 162 may be sized and configured such that fluid may flow through the check valve body insert 150, around the sides of the ball 162, and out through the check valve body insert 150 through the apertures 166 when the ball 162 is located at the opposite end 164 of the check valve body insert 150 and separated from the sealing ring member 160 (FIG. 2). Thus, forward flow of the subject fluid through the pump 100 and the check valve assembly 130 is enabled when the ball 162 is in the position at the opposite end 164 of the check valve body insert 150 and separated from the sealing ring member 160. FIG. 3C is a bottom view of the check valve assembly 130 illustrating the ball 162 seated against the sealing ring member 160.

Figure 4:
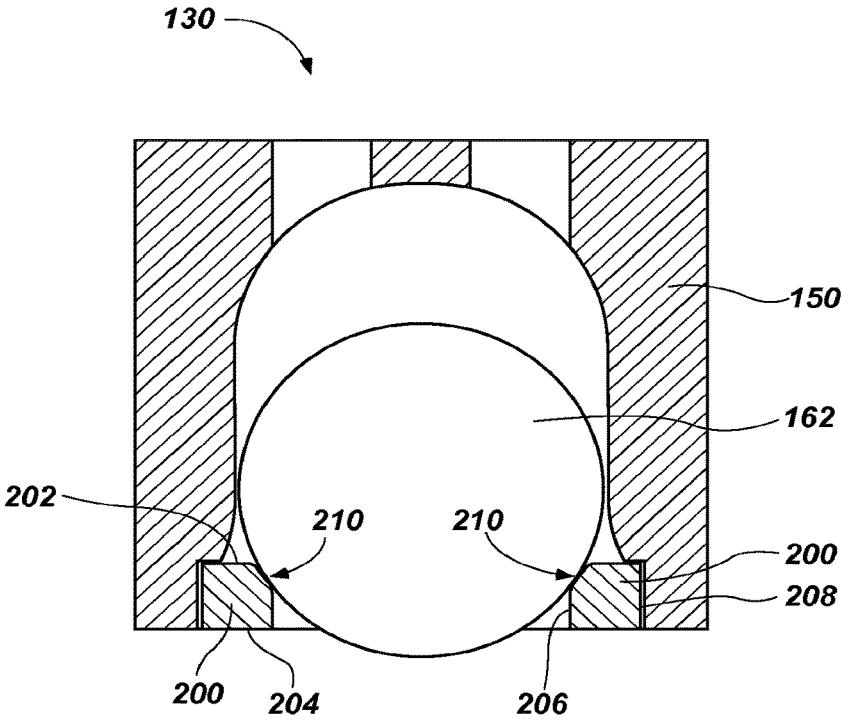
FIG. 4 is similar to FIG. 2 and illustrates another embodiment of a sealing ring member that may be employed in additional embodiments of the disclosure.

FIG. 4 illustrates an additional embodiment of a sealing ring member 200 that may be employed in embodiments of the present disclosure. As shown in FIG. 4, in some embodiments, the annular sealing ring member 200 may have an at least substantially planar top surface 202, an at least substantially planar bottom surface 204, an at least substantially cylindrical laterally inner side surface 206, and an at least substantially cylindrical laterally outer side surface 208. As shown in FIG. 4, the sealing ring member 200 may have a rounded edge 210 between the planar top surface 202 and the laterally inner side surface 206, and the ball 162 may be configured to abut and seal against the rounded edge 210 when the ball 162 is in the sealing position abutting against the sealing ring member 200. The rounded edge 210 may have a radius of curvature greater than a radius of curvature of any of the other edges of the sealing ring member 200 defined by the intersections between the surfaces 202, 204, 206, and 208.

In some embodiments, annular sealing ring members used in fluid pumps of the present disclosure may include one or more grooves therein that extend around the sealing ring members.

Figure 5:
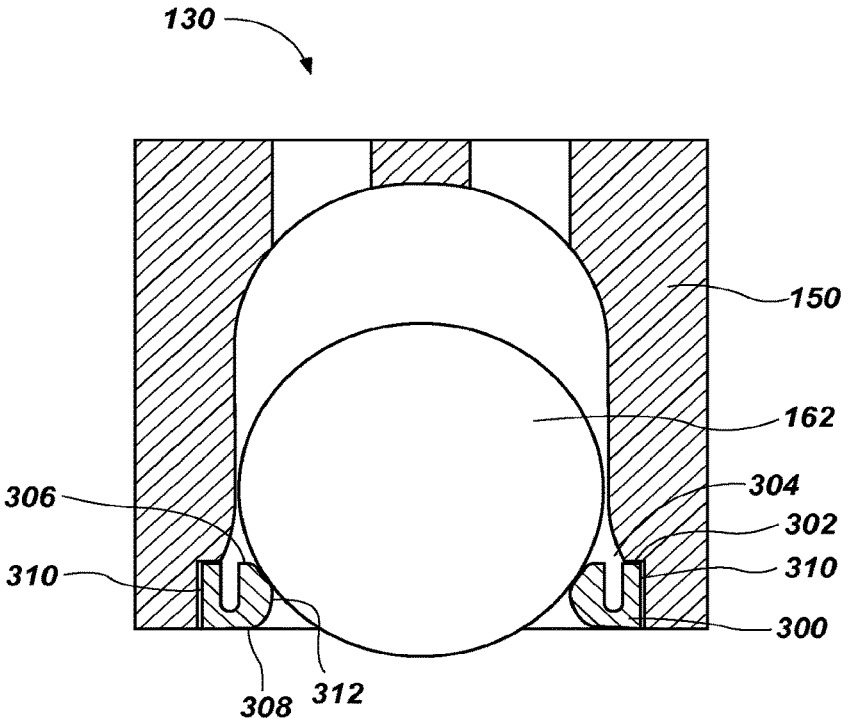
FIG. 5 is similar to FIG. 2 and illustrates another embodiment of a sealing ring member that may be employed in additional embodiments of the disclosure.

For example, FIG. 5 illustrates another embodiment of a sealing ring member 300 that includes an outer surface 302 having a shape defining at least one groove 304 extending into the sealing ring member 300. The groove 304 extends continuously and circumferentially around the sealing ring member 300. In the embodiment of FIG. 5, the sealing ring member 300 has a D-shaped cross-sectional geometry similar to that of FIGS. 1 and 2, and has a substantially planar top surface 306, a substantially planar bottom surface 308, a substantially cylindrical laterally outer side surface 310, and a curved laterally inner side surface 312. The groove 304 extends into an interior region of the sealing ring member 300 from the substantially planar top surface 306 of the sealing ring member 300 in the embodiment of FIG. 5.

In additional embodiments of the present disclosure, a groove may extend into the interior region of the sealing ring member from other exterior surfaces of the sealing ring member.

Figure 6:
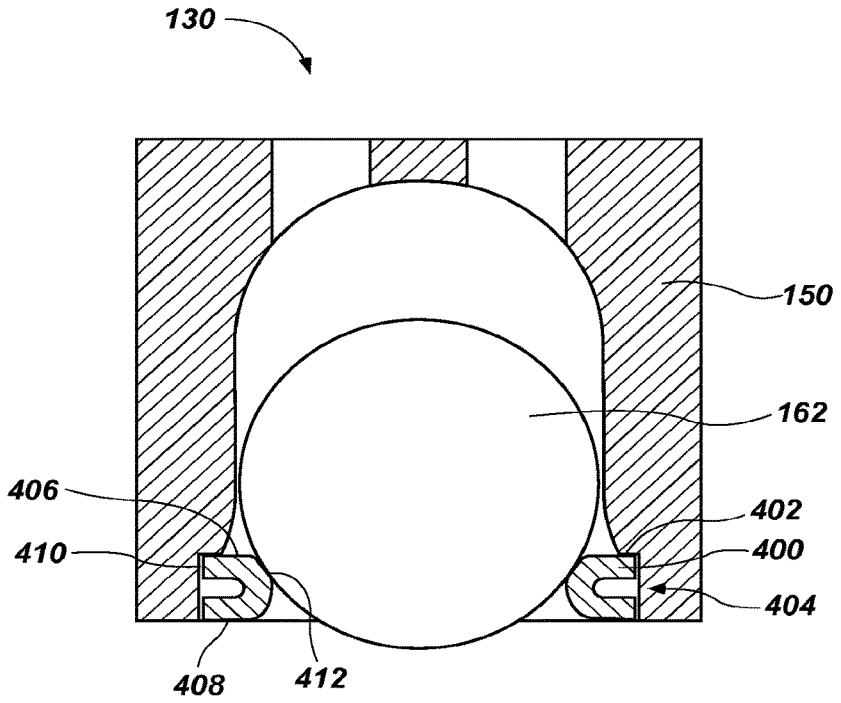
FIG. 6 is similar to FIG. 2 and illustrates another embodiment of a sealing ring member that may be employed in additional embodiments of the disclosure.

FIG. 6 illustrates another embodiment of a sealing ring member 400 that includes an outer surface 402 having a shape defining at least one groove 404 extending into the sealing ring member 400. The groove 404 extends continuously and circumferentially around the sealing ring member 400. The sealing ring member 400 of FIG. 6 also has a D-shaped cross-sectional geometry, and has a substantially planar top surface 406, a substantially planar bottom surface 408, a substantially cylindrical laterally outer side surface 410, and a curved laterally inner side surface 412. The groove 404 extends into an interior region of the sealing ring member 400 from the substantially cylindrical laterally outer side surface 410 of the sealing ring member 400 in the embodiment of FIG. 6.

Figure 7:
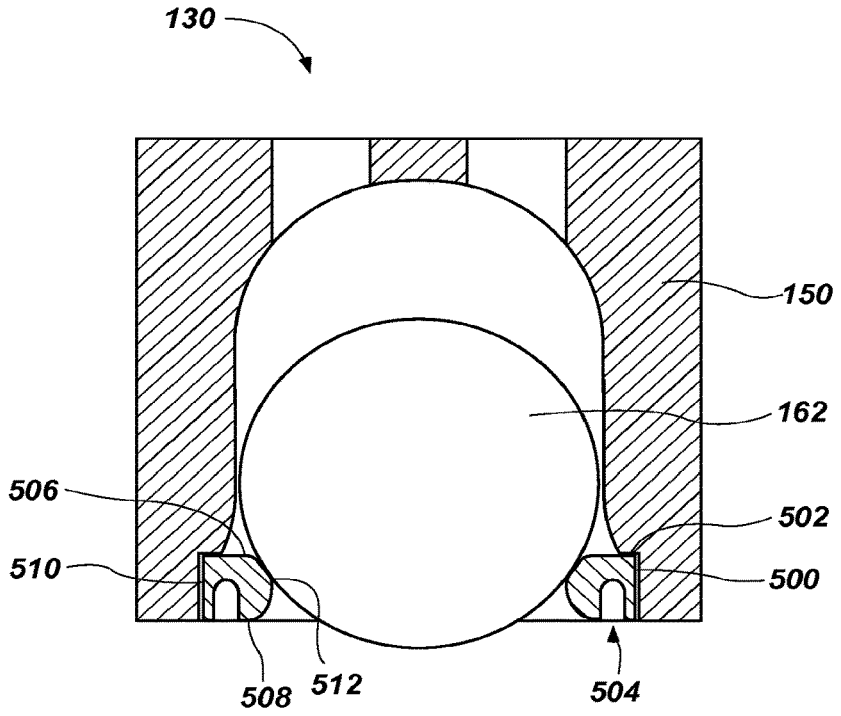
FIG. 7 is similar to FIG. 2 and illustrates another embodiment of a sealing ring member that may be employed in additional embodiments of the disclosure.

FIG. 7 illustrates another embodiment of a sealing ring member 500 that includes an outer surface 502 having a shape defining at least one groove 504 extending into the sealing ring member 500. The groove 504 extends continuously and circumferentially around the sealing ring member 500. The sealing ring member 500 of FIG. 7 also has a D-shaped cross-sectional geometry, and has a substantially planar top surface 506, a substantially planar bottom surface 508, a substantially cylindrical laterally outer side surface 510, and a curved laterally inner side surface 512. The groove 504 extends into an interior region of the sealing ring member 500 from the substantially planar bottom surface 508 of the sealing ring member 500 in the embodiment of FIG. 7.

Figure 8:
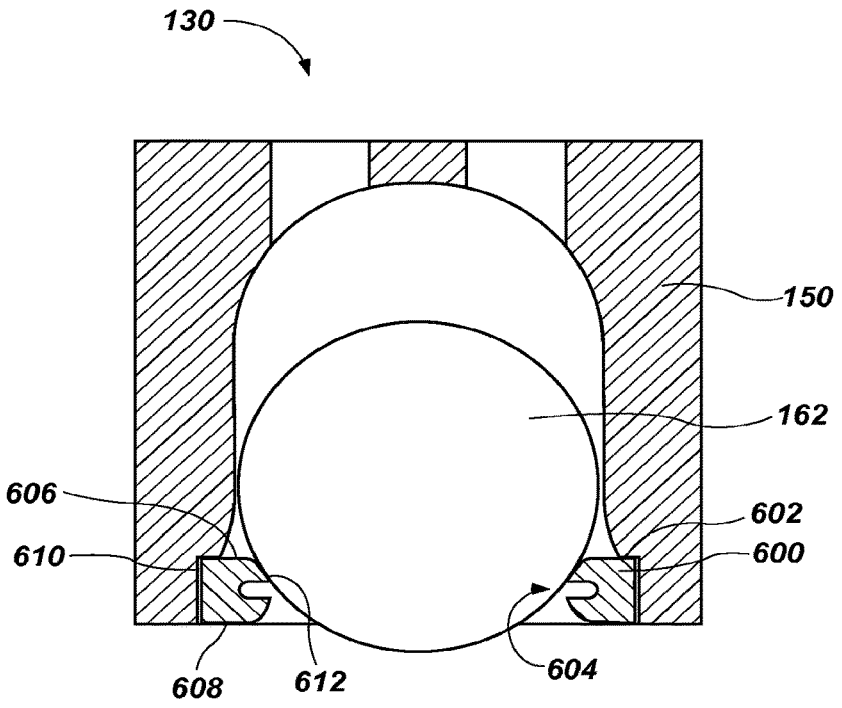
FIG. 8 is similar to FIG. 2 and illustrates another embodiment of a sealing ring member that may be employed in additional embodiments of the disclosure.

FIG. 8 illustrates another embodiment of a sealing ring member 600 that includes an outer surface 602 having a shape defining at least one groove 604 extending into the sealing ring member 600. The groove 604 extends continuously and circumferentially around the sealing ring member 600. The sealing ring member 600 of FIG. 8 also has a D-shaped cross-sectional geometry, and has a substantially planar top surface 606, a substantially planar bottom surface 608, a substantially cylindrical laterally outer side surface 610, and a curved laterally inner side surface 612. The groove 604 extends into an interior region of the sealing ring member 600 from the curved laterally inner side surface 612 of the sealing ring member 600 in the embodiment of FIG. 8.

In additional embodiments of the present disclosure, the outer surface of a sealing ring member used in a check valve assembly 130 may have a shape defining a plurality of grooves extending into the sealing ring member, and each of the grooves may extend continuously and circumferentially around the sealing ring member.

Figure 9:
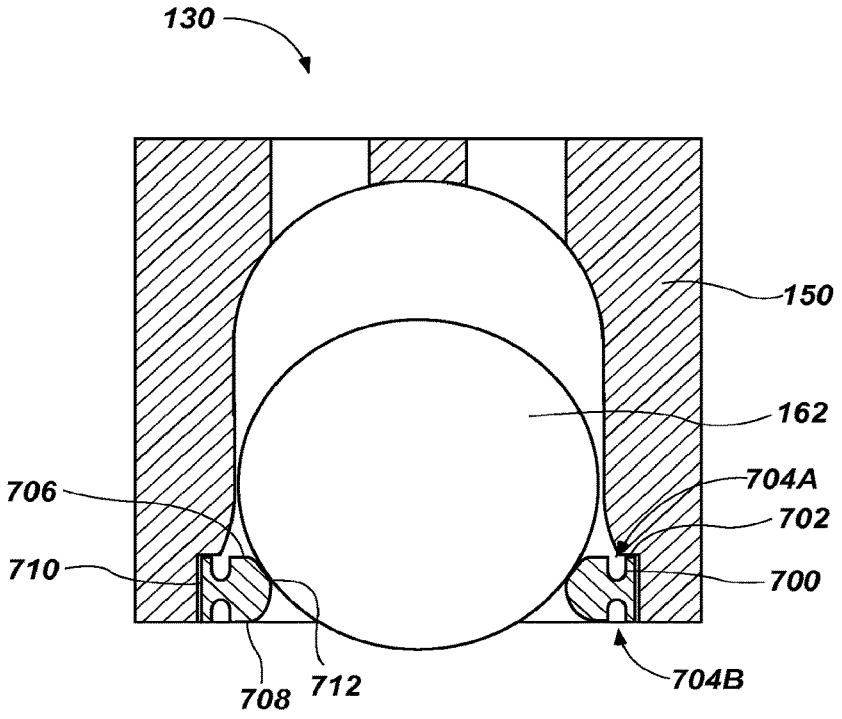
FIG. 9 is similar to FIG. 2 and illustrates another embodiment of a sealing ring member that may be employed in additional embodiments of the disclosure.

For example, FIG. 9 illustrates another embodiment of a sealing ring member 700 that includes an outer surface 702 having a shape defining a first groove 704A and a second groove 704B, each of which extends into the sealing ring member 700. The grooves 704A, 704B extend continuously and circumferentially around the sealing ring member 700. The sealing ring member 700 may have a D-shaped cross-sectional geometry, and may include a substantially planar top surface 706, a substantially planar bottom surface 708, a substantially cylindrical laterally outer side surface 710, and a curved laterally inner side surface 712. The first groove 704A may extend into an interior region of the sealing ring member 700 from the substantially planar top surface 706, and the second groove 704B may extend into an interior region of the sealing member 700 from the substantially planar bottom surface 708 of the sealing ring member 700.

Figure 10:
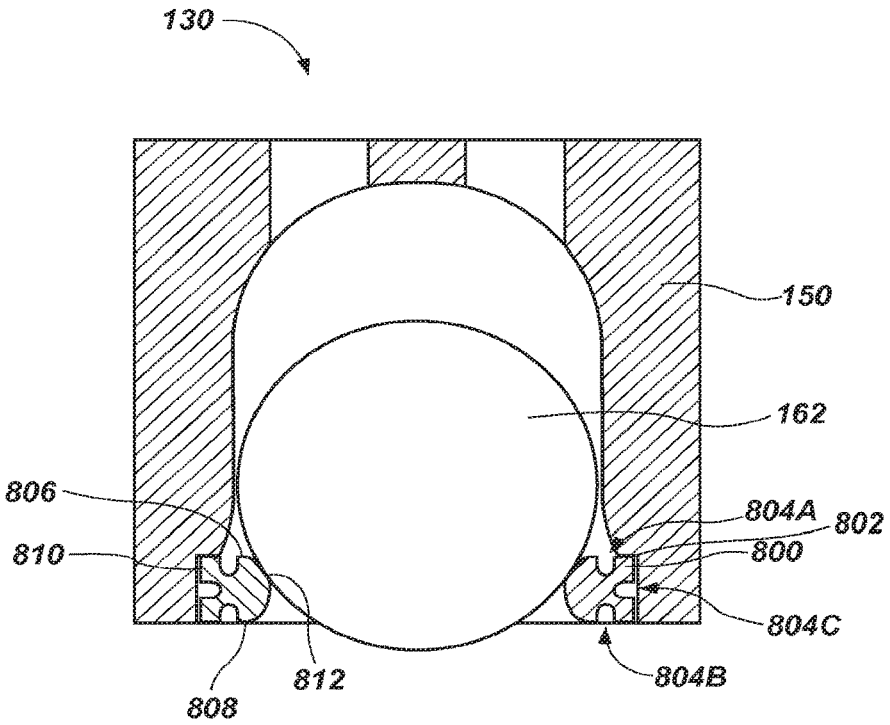
FIG. 10 is similar to FIG. 2 and illustrates another embodiment of a sealing ring member that may be employed in additional embodiments of the disclosure.

FIG. 10 illustrates another embodiment of a sealing ring member 800 that includes an outer surface 802 having a shape defining a first groove 804A, a second groove 804B, and a third groove 804C, each of which extends into the sealing ring member 800. The grooves 804A, 804B, 804C extend continuously and circumferentially around the sealing ring member 800. The sealing ring member 800 may have a D-shaped cross-sectional geometry, and may include a substantially planar top surface 806, a substantially planar bottom surface 808, a substantially cylindrical laterally outer side surface 810, and a curved laterally inner side surface 812. The first groove 804A may extend into an interior region of the sealing ring member 800 from the substantially planar top surface 806, the second groove 804B may extend into an interior region of the sealing ring member 800 from the substantially planar bottom surface 808, and the third groove 804C may extend into an interior region of the sealing member 800 from the substantially cylindrical laterally outer side surface 810 of the sealing ring member 800.

Figure 11:
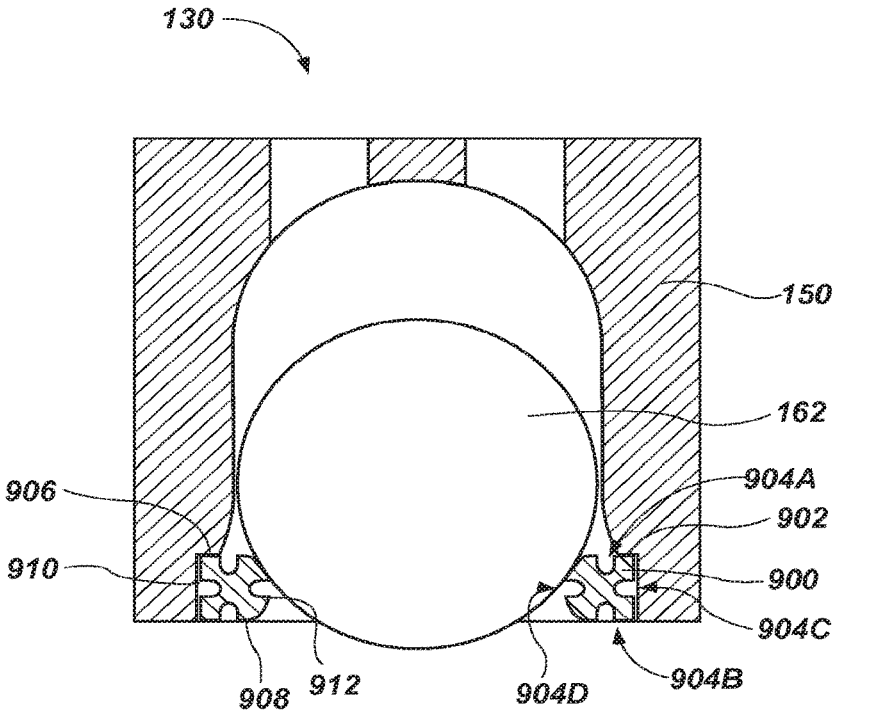
FIG. 11 is similar to FIG. 2 and illustrates another embodiment of a sealing ring member that may be employed in additional embodiments of the disclosure.

FIG. 11 illustrates another embodiment of a sealing ring member 900 that includes an outer surface 902 having a shape defining a first groove 904A, a second groove 904B, a third groove 904C, and a fourth groove 904D, each of which extends into the sealing ring member 900. The grooves 904A-904D extend continuously and circumferentially around the sealing ring member 900. The sealing ring member 900 may have a D-shaped cross-sectional geometry, and may include a substantially planar top surface 906, a substantially planar bottom surface 908, a substantially cylindrical laterally outer side surface 910, and a curved laterally inner side surface 912. The first groove 904A may extend into an interior region of the sealing ring member 900 from the substantially planar top surface 906. The second groove 904B may extend into an interior region of the sealing ring member 900 from the substantially planar bottom surface 908. The third groove 904C may extend into an interior region of the sealing member 900 from the substantially cylindrical laterally outer side surface 910 of the sealing ring member 900. Finally, the fourth groove 904D may extend into an interior region of the sealing member 900 from the curved laterally inner side surface 912 of the sealing ring member 900.

Of course, in additional embodiments of the present disclosure, the sealing ring members of the one or more check valve assemblies 130 of the fluid pump 100 may have any cross-sectional shape, and may include any number of grooves extending into the sealing ring member as described herein from any of the exterior surface or surfaces thereof.

In yet further embodiments of the present disclosure, sealing ring members as disclosed herein may be hollow, and may have one or more inner surfaces defining at least one circumferential tubular cavity extending continuously and circumferentially around and within the sealing ring member.

Figure 12:
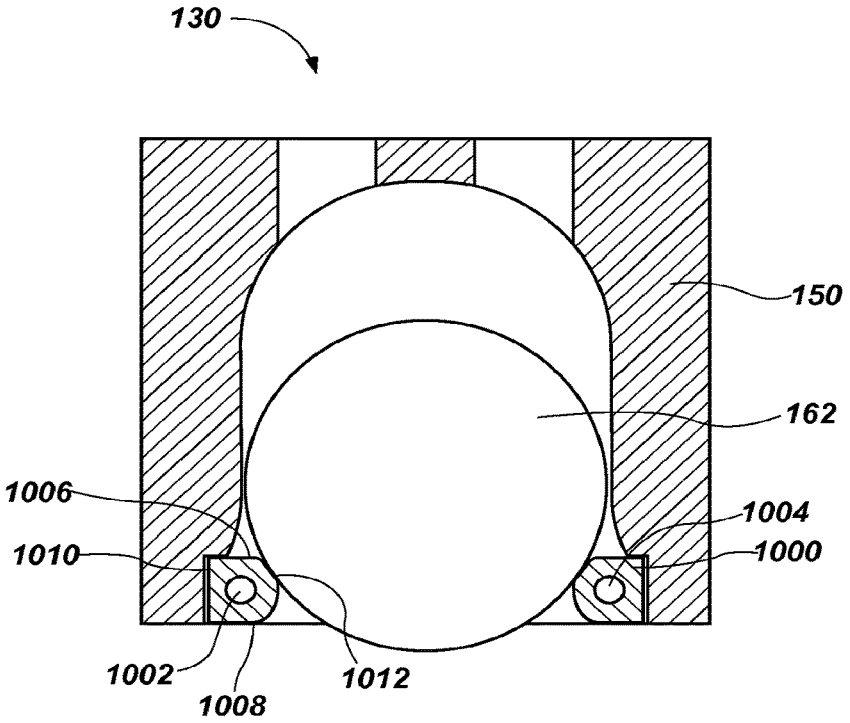
FIG. 12 is similar to FIG. 2 and illustrates another embodiment of a sealing ring member that may be employed in additional embodiments of the disclosure.

For example, FIG. 12 illustrates another embodiment of a sealing ring member 1000 that includes an inner surface 1002 defining tubular cavity 1004 extending continuously and circumferentially around and within the sealing ring member 1000. The sealing ring member 1000 of FIG. 12 has a D-shaped cross-sectional geometry, and has a substantially planar top surface 1006, a substantially planar bottom surface 1008, a substantially cylindrical laterally outer side surface 1010, and a curved laterally inner side surface 1012. In other embodiments, the geometry of the sealing ring member 1000 may have any other cross-sectional shape, such as any of those described herein. In addition, in additional embodiments of the disclosure, the sealing ring member 1000 may include one or more grooves extending into an interior region of the sealing ring member 1000 from an outer surface or surfaces thereof, as previously described herein.

Figure 13:
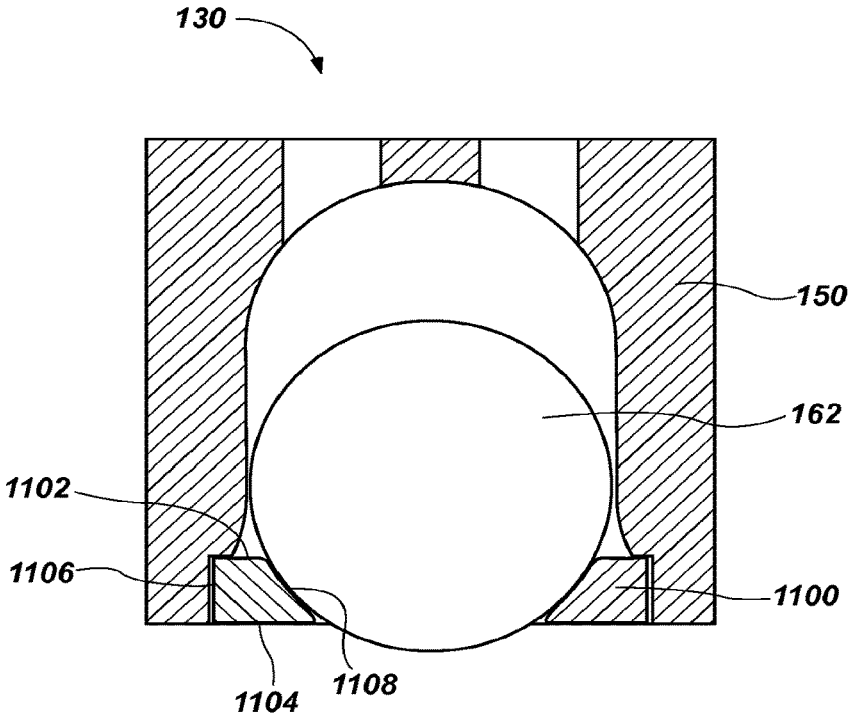
FIG. 13 is similar to FIG. 2 and illustrates another embodiment of a sealing ring member that may be employed in additional embodiments of the disclosure.

FIG. 13 illustrates yet another embodiment of a sealing ring member 1100 of the present disclosure. The sealing ring member 1100 has an at least substantially planar top surface 1102, an at least substantially planar bottom surface 1104, a substantially cylindrical laterally outer side surface 1106, and an annular surface 1108 extending between the top surface 1102 and the bottom surface 1104. The annular surface 1108 has a shape corresponding to a portion of a spherical surface and complementary to the surface of the ball 162 of the check valve assembly 130. Such a geometry may provide increased surface contact area between the sealing ring member 1100 and the ball 162, and may improve the fluid seal established therebetween during operation of the fluid pump 100.

Figure 14:
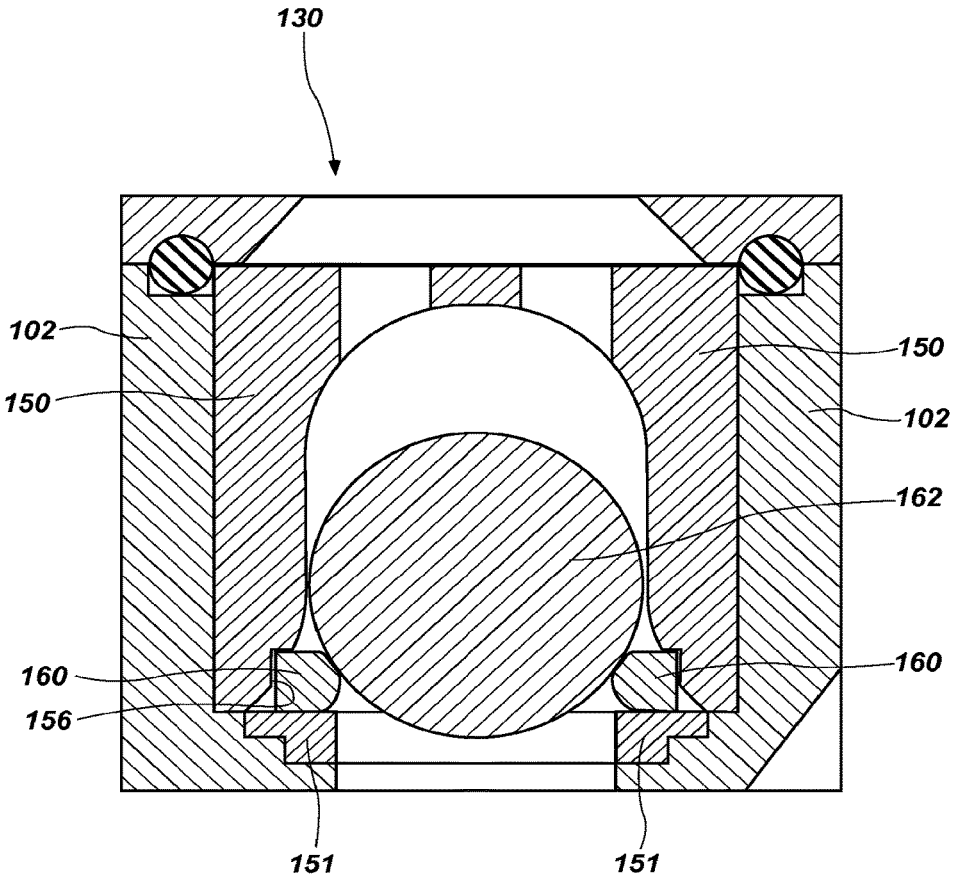
FIG. 14 is similar to FIG. 2 and illustrates another embodiment of a sealing ring member that may be employed in additional embodiments of the disclosure.

FIG. 14 illustrates another embodiment of a check valve assembly 130 similar to that of FIG. 2, but further including a ring retention member 151 in addition to the check valve body insert 150, the sealing ring member 160, and the ball 162. The ring retention member 151 may be disposed on an opposing side of the sealing ring member 160 from the check valve body insert 150, such that the sealing ring member 160 is disposed between the ring retention member 151 and the check valve body insert 150. Thus, the seat ring receptacle 156 is defined by surfaces of the ring retention member 151 and the check valve body insert 150 when they are assembled together. Use of such a removable ring retention member 151 under the sealing ring member 160 allows an area of the fluid pump 100 subject to wear to be rebuilt and/or replaced, which avoids the expense of replacing the entire pump body 102.

The components of the check valve assemblies 130 described herein, including each of the check valve body insert 150, the ball 162, and the various sealing ring members, may be formed from and comprise a polymer material such as, for example, a polyethylene (e.g., ultra-high molecular weight polyethylene), polypropylene, or any of the materials previously mentioned as being suitable for use in components of the pump 100 that may come into contact with acid. In some embodiments, the sealing ring member 160 may exhibit a durometer lower than a durometer of the other components of the check valve assembly 130.

Additional embodiments of the disclosure include methods of manufacturing fluid pumps as described herein, such as the fluid pump 100 of FIG. 1. Referring again to FIGS. 1 and 2, to form the fluid pump 100, a pump body 102 having at least one interior cavity therein may be provided. A plunger 120, 122 may be disposed within the interior cavity 110, 112, such that the pump body 102 and the plunger 120, 122 define a subject fluid chamber 126, 128 within the interior cavity 110, 112 on a first side of the plunger 120, 122 and a drive fluid chamber 127, 129 within the interior cavity 110, 112 on an opposing second side of the plunger 120, 122. The plunger 120, 122 may be configured to expand and contract the subject fluid chamber 126, 128 responsive to pressurization and depressurization of the drive fluid chamber 127, 129 with a drive fluid. An annular sealing ring member, such as the sealing ring member 160 or any other sealing ring member described herein, may be disposed within a recess 152 in the pump body 102. A ball 162 may be disposed in a check valve body insert 150, and the check valve body insert 150, with the ball 162 therein, may be secured in the recess 152 in the pump body 102 such that the check valve body insert 150 and surfaces 154 of the pump body 102 within the recess 152 together define an annular seat ring receptacle 156 between an end 158 of the check valve body insert 150 and the surfaces 154 of the pump body 102 within the recess 152. The annular sealing ring member 160 may be disposed within the annular seat ring receptacle 156. As previously described herein, the sealing ring member 160 may have dimensions smaller than corresponding dimensions of the seat ring receptacle 156 such that the sealing ring member 160 is capable of moving longitudinally and laterally within the seat ring receptacle 156. Thus assembled, the check valve body insert 150, the ball 162, and the annular sealing ring member 160 together define a check valve assembly 130. The ball 162 may be configured to slide back and forth between a first position and a second position within the check valve body insert 150 responsive to forward and reverse flow of the subject fluid through the check valve assembly 130. The ball 162 may be seated against the sealing ring member and prevent reverse flow of the subject fluid when the ball 162 is in the second position within the check valve body insert 150. Forward flow of the subject fluid through the check valve assembly 130 may be enabled when the ball 162 is in the first position.

In some embodiments, the methods disclosed herein may include the fabrication of the annular sealing ring members, which may be formed using, for example, an injection molding process, or they may be formed by extruding a linear segment of polymer material, and attaching together opposing longitudinal ends of the linear segment of polymer material to form the annular sealing ring member.

Embodiments of check valve assemblies 130 and the various embodiments of sealing ring members described herein may improve the tightness of the fluid seals established when the balls 162 of the check valve assemblies 130 are seated against the respective annular sealing ring members to at least substantially prevent reverse flow of subject fluid within a fluid pump 100. In addition, the tightness of the fluid seal may remain sufficiently high over higher numbers of operating cycles compared to fluid pumps incorporating previously known check valve assemblies, which may lengthen the usable life of check valve assemblies and fluid pumps of the present disclosure relative to previously known designs.

Additional non-limiting example embodiments of the present disclosure are set forth below.

Embodiment 1

A pneumatic reciprocating fluid pump for pumping a subject fluid, the pump comprising: a pump body having at least one interior cavity therein; a plunger disposed within the at least one interior cavity in the pump body, the pump body and the plunger defining at least one subject fluid chamber within the at least one interior cavity on a first side of the plunger and at least one subject fluid chamber within the at least one interior cavity on an opposing second side of the plunger, the plunger configured to expand and contract the first subject fluid chamber responsive to pressurization and depressurization of the drive fluid chamber with a drive fluid; and at least one check valve assembly located and configured to allow forward flow of the subject fluid flowing through the fluid pump and at least substantially prevent reverse flow of the subject fluid flowing through the fluid pump, the at least one check valve assembly including: a check valve body insert configured to be received in a complementary recess in the pump body, the check valve body insert and surfaces of the pump body within the complementary recess together defining an annular seat ring receptacle between an end of the check valve body insert and the surfaces of the body within the complementary recess; an annular sealing ring member disposed within the seat ring receptacle, the sealing ring member having dimensions smaller than corresponding dimensions of the seat ring receptacle such that the sealing ring member is capable of moving longitudinally and laterally within the seat ring receptacle; and a ball disposed within the check valve body insert and configured to slide back and forth between a first position and a second position within the check pump body insert responsive to forward and reverse flow of the subject fluid through the at least one check valve assembly, the ball seated against the sealing ring member and preventing reverse flow of the subject fluid when the ball is in the second position within the check valve body insert, forward flow of the subject fluid through the at least one check valve assembly being enabled when the ball is in the first position.

Embodiment 2

The fluid pump of Embodiment 1, wherein the sealing ring member has a non-circular cross-sectional shape.

Embodiment 3

The fluid pump of Embodiment 2, wherein a cross-section of the sealing ring member has a D-shape.

Embodiment 4

The fluid pump of Embodiment 2, wherein an outer surface of the sealing ring member has a shape defining at least one groove extending into the sealing ring member, the groove extending continuously and circumferentially around the sealing ring member.

Embodiment 5

The fluid pump of Embodiment 4, wherein the groove extends into the sealing ring member from a top surface of the sealing ring member.

Embodiment 6

The fluid pump of Embodiment 4, wherein the groove extends into the sealing ring member from a bottom surface of the sealing ring member.

Embodiment 7

The fluid pump of Embodiment 4, wherein the groove extends into the sealing ring member from a laterally outer side surface of the sealing ring member.

Embodiment 8

The fluid pump of Embodiment 4, wherein the groove extends into the sealing ring member from a laterally inner side surface of the sealing ring member.

Embodiment 9

The fluid pump of Embodiment 4, wherein the outer surface of the sealing ring member has a shape defining a plurality of grooves extending into the sealing ring member, each groove of the plurality of grooves extending continuously and circumferentially around the sealing ring member.

Embodiment 10

The fluid pump of Embodiment 9, wherein the plurality of grooves comprises: a first groove extending into the sealing ring member from a top surface of the sealing ring member; and a second groove extending into the sealing ring member from a bottom surface of the sealing ring member.

Embodiment 11

The fluid pump of Embodiment 10, wherein the plurality of grooves further comprises a third groove extending into the sealing ring member from a laterally outer side surface of the sealing ring member.

Embodiment 12

The fluid pump of Embodiment 11, wherein the plurality of grooves further comprises a fourth groove extending into the sealing ring member from a laterally inner side surface of the sealing ring member.

Embodiment 13

The fluid pump of Embodiment 2, wherein the sealing ring member comprises: an at least substantially planar top surface; an at least substantially planar bottom surface; and an annular surface extending between the top surface and the bottom surface having a shape corresponding to a portion of a spherical surface and complementary to the surface of the ball.

Embodiment 14

The fluid pump of Embodiment 2, wherein the sealing ring member comprises: an at least substantially planar top surface; an at least substantially planar bottom surface; an at least substantially cylindrical laterally inner side surface; and a rounded edge between the top surface and the laterally inner side surface, the ball configured to abut and seal against the rounded edge when the ball is in the second position.

Embodiment 15

The fluid pump of Embodiment 1, wherein the sealing ring member is hollow and has an inner surface defining at least one circumferential tubular cavity extending continuously around and within the sealing ring member.

Embodiment 16

A method of manufacturing a pneumatic reciprocating fluid pump for pumping a subject fluid, the method comprising: providing a pump body having at least one interior cavity therein and a plunger disposed within the at least one interior cavity, the pump body and the plunger defining at least one subject fluid chamber within the at least one interior cavity on a first side of the plunger and at least one drive fluid chamber within the at least one interior cavity on an opposing second side of the plunger, the plunger configured to expand and contract the first subject fluid chamber responsive to pressurization and depressurization of the drive fluid chamber with a drive fluid; disposing an annular sealing ring member within a recess in the pump body; disposing a ball in a check valve body insert and securing the check valve body insert with the ball therein in the recess in the pump body such that the check valve body insert and surfaces of the pump body within the recess together define an annular seat ring receptacle between an end of the check valve body insert and the surfaces of the body within the recess, the annular sealing ring member disposed within the annular seat ring receptacle, the sealing ring member having dimensions smaller than corresponding dimensions of the seat ring receptacle such that the sealing ring member is capable of moving longitudinally and laterally within the seat ring receptacle; wherein the check valve body insert, the ball, and the annular sealing ring member together defining a check valve assembly, the ball configured to slide back and forth between a first position and a second position within the check valve body insert responsive to forward and reverse flow of the subject fluid through the at least one check valve assembly, the ball seated against the sealing ring member and preventing reverse flow of the subject fluid when the ball is in the second position within the check valve body insert, forward flow of the subject fluid through the at least one check valve assembly being enabled when the ball is in the first position.

Embodiment 17

The method of Embodiment 16, further comprising selecting the sealing ring member to have a non-circular cross-sectional shape.

Embodiment 18

The method of Embodiment 17, further comprising selecting the sealing ring member to have a D-shaped cross-section.

Embodiment 19

The method of Embodiment 17, further comprising selecting the sealing ring member to comprise an outer surface having a shape defining at least one groove extending into the sealing ring member, the groove extending continuously and circumferentially around the sealing ring member.

Embodiment 20

The method of Embodiment 17, further comprising selecting the sealing ring member to comprise: an at least substantially planar top surface; an at least substantially planar bottom surface; and an annular surface extending between the top surface and the bottom surface having a shape corresponding to a portion of a spherical surface and complementary to the surface of the ball.

Embodiment 21

The method of Embodiment 17, further comprising selecting the sealing ring member to comprise: an at least substantially planar top surface; an at least substantially planar bottom surface; an at least substantially cylindrical laterally inner side surface; and a rounded edge between the top surface and the laterally inner side surface, the ball configured to abut and seal against the rounded edge when the ball is in the second position.

Embodiment 22

The method of Embodiment 17, further comprising selecting the sealing ring member to have a hollow shape including an inner surface defining at least one circumferential tubular cavity extending continuously around and within the sealing ring member.

Embodiment 23

The method of Embodiment 16, further comprising forming the annular sealing ring member.

Embodiment 24

The method of Embodiment 23, further comprising forming the annular sealing ring member using an injection molding process.

Embodiment 25

The method of Embodiment 24, wherein forming the annular sealing ring member comprises extruding a linear segment of polymer material, and attaching together opposing longitudinal ends of the linear segment of polymer material to form the annular sealing ring member.

The embodiments of the disclosure described above and illustrated in the accompanying drawing figures do not limit the scope of the invention, since these embodiments are merely examples of embodiments of the invention, which is defined by the appended claims and their legal equivalents.

Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A method of manufacturing a pneumatic reciprocating fluid pump for pumping a subject fluid, the method comprising:

providing a pump body having at least one interior cavity therein and a plunger disposed within the at least one interior cavity, the pump body and the plunger defining at least one subject fluid chamber within the at least one interior cavity on a first side of the plunger and at least one drive fluid chamber within the at least one interior cavity on an opposing second side of the plunger, the plunger configured to expand and contract the at least one subject fluid chamber responsive to pressurization and depressurization of the at least one drive fluid chamber with a drive fluid;

disposing an annular sealing ring member within a recess in the pump body, the annular sealing ring member comprising an outer surface having a shape defining at least one groove extending into the annular sealing ring member, the at least one groove extending continuously and circumferentially around the annular sealing ring member;

disposing a ball at least partially in a check valve body insert and securing the check valve body insert with the ball therein in the recess in the pump body such that the check valve body insert defines a first side and a second side of an annular seat ring receptacle, and at least one surface of the pump body within the recess defines a third side of the annular seat ring receptacle, the second side abutting against the third side, the annular sealing ring member disposed within the annular seat ring receptacle, the annular sealing ring member having dimensions smaller than corresponding dimensions of the annular seat ring receptacle such that the annular sealing ring member is capable of moving longitudinally and laterally within the annular seat ring receptacle;

wherein the check valve body insert, the ball, and the annular sealing ring member together defining at least one check valve assembly, the ball configured to slide back and forth between a first position and a second position within the check valve body insert responsive to forward and reverse flow of the subject fluid through the at least one check valve assembly, the ball seated against the annular sealing ring member and preventing reverse flow of the subject fluid when the ball is in the second position within the check valve body insert, forward flow of the subject fluid through the at least one check valve assembly being enabled when the ball is in the first position.

2. The method of claim 1, further comprising selecting the annular sealing ring member to have a non-circular cross-sectional shape with the at least one groove protruding into the non-circular cross-sectional shape.

3. The method of claim 1, further comprising selecting the annular sealing ring member to have a D-shaped cross-section with the at least one groove protruding into the D-shaped cross-section.

4. The method of claim 2, further comprising selecting the annular sealing ring member to comprise:

an at least substantially planar top surface;

an at least substantially planar bottom surface; and an annular surface extending between the at least substantially planar top surface and the at least substantially planar bottom surface having a shape corresponding to a portion of a spherical surface and complementary to the surface of the ball, wherein the at least one groove extends into at least one of the at least substantially planar top surface, the at least substantially planar bottom surface, or the annular surface.

5. The method of claim 2, further comprising selecting the annular sealing ring member to comprise:

an at least substantially planar top surface;

an at least substantially planar bottom surface;

an at least substantially cylindrical laterally inner side surface; and a rounded edge between the at least substantially planar top surface and the laterally inner side surface, the ball configured to abut and seal against the rounded edge when the ball is in the second position.

6. The method of claim 1, further comprising forming the annular sealing ring member.

7. The method of claim 6, further comprising forming the annular sealing ring member using an injection molding process.

8. The method of claim 7, wherein forming the annular sealing ring member comprises extruding a linear segment of polymer material, and attaching together opposing longitudinal ends of the linear segment of polymer material to form the annular sealing ring member.

9. The method of claim 1, wherein the annular sealing ring member comprises an outer surface having a shape defining a plurality of grooves extending into the annular sealing ring member.

10. A method of manufacturing a pneumatic reciprocating fluid pump for pumping a subject fluid, the method comprising:

forming a pump body having at least one interior cavity therein;

disposing a plunger within the at least one interior cavity in the pump body, the pump body and the plunger defining at least one subject fluid chamber within the at least one interior cavity on a first side of the plunger and at least one drive fluid chamber within the at least one interior cavity on an opposing second side of the plunger, the plunger configured to expand and contract the at least one subject fluid chamber responsive to pressurization and depressurization of the at least one drive fluid chamber with a drive fluid; and forming at least one check valve assembly and positioning the at least one check valve assembly within the pump body, the at least one check valve assembly configured to allow forward flow of the subject fluid flowing through the fluid pump and at least substantially prevent reverse flow of the subject fluid flowing through the fluid pump, comprising:

disposing a check valve body insert in a complementary recess in the pump body, the check valve body insert defining a first side and a second side of an annular seat ring receptacle, and at least one surface of the pump body within the complementary recess defining a third side of the annular seat ring receptacle, wherein the second side abuts against the third side;

disposing an annular sealing ring member within the annular seat ring receptacle, the annular sealing ring member having dimensions smaller than corresponding dimensions of the annular seat ring receptacle such that the annular sealing ring member is capable of moving longitudinally and laterally within the annular seat ring receptacle, an outer surface of the annular sealing ring member having a shape defining at least one groove extending into the annular sealing ring member, the at least one groove extending continuously and circumferentially around the annular sealing ring member; and disposing a ball at least partially within the check valve body insert, the ball being configured to slide back and forth between a first position and a second position within the check valve body insert responsive to forward and reverse flow of the subject fluid through the at least one check valve assembly, the ball seated against the annular sealing ring member and preventing reverse flow of the subject fluid when the ball is in the second position within the check valve body insert, enabling forward flow of the subject fluid through the at least one check valve assembly when the ball is in the first position.

11. The method of claim 10, further comprising selecting the annular sealing ring member to have a D-shaped cross-section with the at least one groove extending into the D-shaped cross-section.

12. The method of claim 10, further comprising selecting the annular sealing ring member to include the at least one groove extending into the annular sealing ring member from a top surface of the annular sealing ring member.

13. The method of claim 10, further comprising selecting the annular sealing ring member to include the at least one groove extending into the annular sealing ring member from a bottom surface of the annular sealing ring member.

14. The method of claim 10, further comprising selecting the annular sealing ring member to include the at least one groove extending into the annular sealing ring member from a laterally outer side surface of the annular sealing ring member.

15. The method of claim 10, further comprising selecting the annular sealing ring member to include the at least one groove extending into the annular sealing ring member from a laterally inner side surface of the annular sealing ring member.

16. The method of claim 10, further comprising selecting the annular sealing ring member to include a plurality of grooves extending continuously and circumferentially around the annular sealing ring member.

17. The method of claim 16, wherein selecting the annular sealing ring member to include the plurality of grooves comprises selecting the annular sealing ring member to include:

a first groove extending into the annular sealing ring member from a top surface of the annular sealing ring member; and a second groove extending into the annular sealing ring member from a bottom surface of the annular sealing ring member.

18. The method of claim 17, further comprising selecting the annular sealing ring member to further include a third groove extending into the annular sealing ring member from a laterally outer side surface of the annular sealing ring member.

19. The method of claim 18, wherein further comprising selecting the annular sealing ring member to further include a fourth groove extending into the annular sealing ring member from a laterally inner side surface of the annular sealing ring member.

20. The method of claim 10, further comprising selecting the annular sealing ring member to comprise a material selected from the group consisting of neoprene, buna-N, ethylene propylene diene M-class (EPDM), polyurethane, fluorinated ethylene-propylene (FEP), perfluoroalkoxy fluorocarbon resin (PFA), ethylene-chlorotrifluoroethylene copolymer (ECTFE), ethylene-tetrafluoroethylene copolymer (ETFE), nylon, polyethylene, polyvinylidene fluoride (PVDF), polyvinyl chloride (PVC), nitrile, polyethylene (PE), ultra-high molecular weight polyethylene (UHMWPE), and polypropylene (PP).

* * * * *